US009946203B2

(12) United States Patent
Sone

(10) Patent No.: US 9,946,203 B2
(45) Date of Patent: Apr. 17, 2018

(54) FIXING DEVICE FOR CHANGING A NIP WIDTH

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshihiro Sone, Yokohama Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/255,274

(22) Filed: Sep. 2, 2016

(65) Prior Publication Data

US 2018/0067430 A1 Mar. 8, 2018

(51) Int. Cl.
*G03G 15/20* (2006.01)
*G03G 15/00* (2006.01)

(52) U.S. Cl.
CPC ..... *G03G 15/2064* (2013.01); *G03G 15/2032* (2013.01); *G03G 15/2067* (2013.01); *G03G 15/6588* (2013.01); *G03G 2215/00447* (2013.01)

(58) Field of Classification Search
CPC ..... G03G 15/2064; G03G 15/2032; G03G 15/2035; G03G 15/2067; G03G 15/2071; G03G 2215/2009; G03G 15/6588; G03G 15/6594; G03G 15/5029; G03G 2215/00447; G03G 2215/00481; G03G 2215/00514
USPC ..... 399/329, 330
See application file for complete search history.

(56) References Cited

U.S. PATENT DOCUMENTS 4,253,008 A * 2/1981 Dolan ..... G03G 15/2064 219/216
8,254,819 B2 * 8/2012 Okamoto ..... G03G 15/2025 399/324
9,285,731 B1 3/2016 Katakura
2010/0322667 A1 * 12/2010 Kitagawa ..... G03G 15/2035 399/122
2010/0329708 A1 * 12/2010 Aslam ..... G03G 15/205 399/45

FOREIGN PATENT DOCUMENTS

JP 04097187 A * 3/1992
JP 10333459 A * 12/1998
JP 2003302858 A * 10/2003
JP 2004004962 A * 1/2004
JP 2007052325 A * 3/2007
JP 2007241320 A * 9/2007
JP 2007310243 A * 11/2007
JP 2008233245 A * 10/2008
(Continued)

*Primary Examiner* — Robert Beatty
(74) *Attorney, Agent, or Firm* — Amin, Turocy & Watson LLP

(57) ABSTRACT

In accordance with an embodiment, a fixing device comprises a first rotating body; a second rotating body configured to face the first rotating body and be stretched over a plurality of rotating bodies; and a first mechanism configured to enable at least one among a plurality of the rotating bodies to move to change a nip width between the first rotating body and the second rotating body.

14 Claims, 6 Drawing Sheets

(56) References Cited

FOREIGN PATENT DOCUMENTS

| | | | | |
|---|---|---|---|---|
| JP | 2011070098 | A | * | 4/2011 |
| JP | 2013045030 | A | * | 3/2013 |
| JP | 2013231764 | A | * | 11/2013 |

* cited by examiner

FIXING DEVICE FOR CHANGING A NIP WIDTH

FIELD

Embodiments described herein relate generally to a fixing device.

BACKGROUND

Conventionally, there are image forming apparatuses such as a Multi-Function Peripheral (hereinafter, referred to as an "MFP") and a printer. The image forming apparatus is equipped with a fixing device. The fixing device is equipped with a heat roller and a belt. The belt is stretched over a plurality of rollers. The fixing device forms a nip between the heat roller and the belt, and fixes a toner image on an image receiving medium through heat of the heat roller. A predetermined pressurizing force is applied to the inside of a nip width. However, according to the type of image receiving medium, if the image receiving medium in the nip width is bent along the outer peripheral surface of the heat roller, there is a possibility that a wrinkle is generated on the image receiving medium.

DETAILED DESCRIPTION

In accordance with an embodiment, a fixing device comprises a first rotating body, a second rotating body and a first mechanism. The second rotating body faces the first rotating body. The second rotating body is stretched over a plurality of rotating bodies. The first mechanism enables at least one of a plurality of the rotating bodies to move to change a nip width between the first rotating body and the second rotating body.

In accordance with another embodiment, a fixing method involving moving a part of a second rotating body in an abutting direction against a first rotating body and a separation direction from the first rotating body, the second rotating body facing the first rotating body; and moving the second rotating body and a pressure member in the abutting direction, against the first rotating body and the separation direction from the first rotating body.

Hereinafter, an image forming apparatus of the embodiment is described with reference to the accompanying drawings. Further, in each Figure, the same numerals are applied to the same components.

Figure 1:
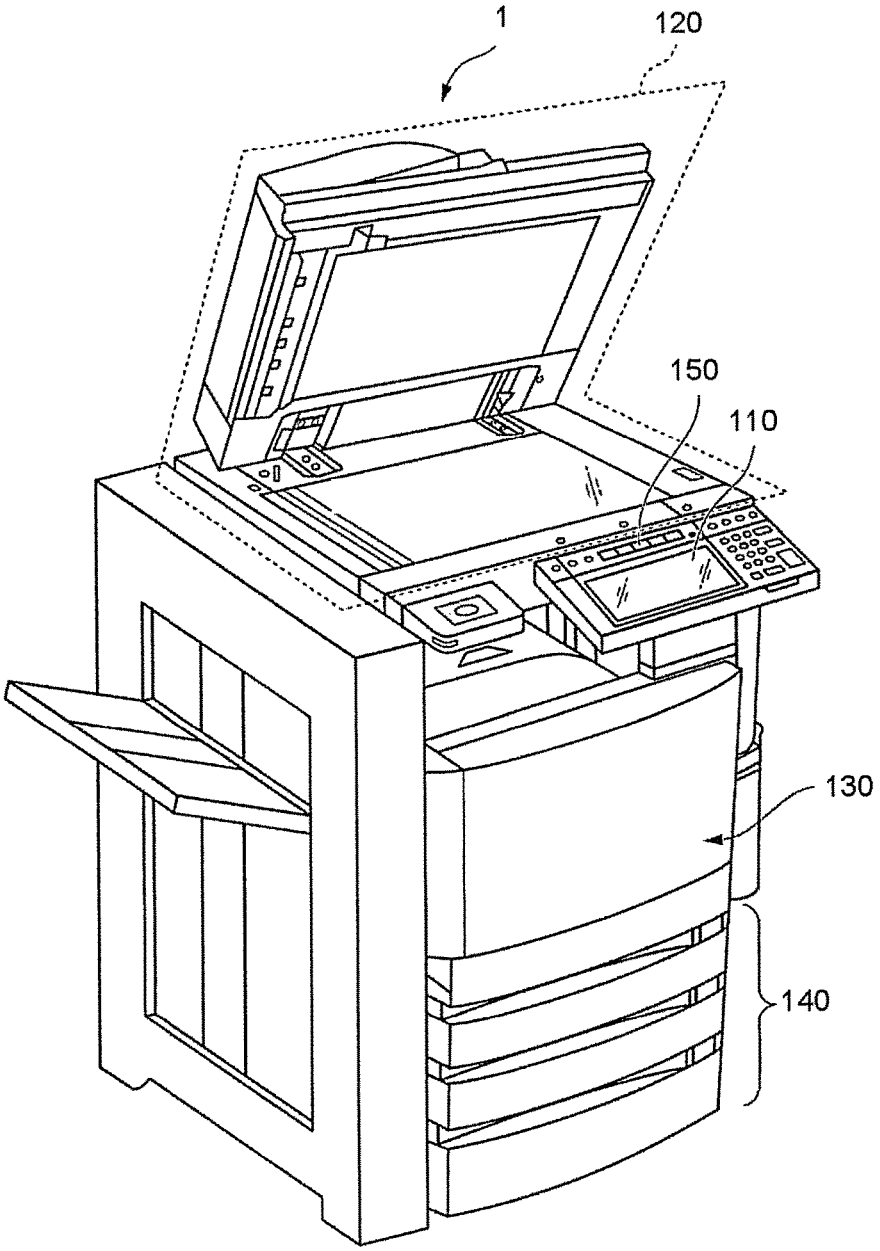
FIG. 1 is an external view illustrating an example of an image forming apparatus according to an embodiment.

FIG. 1 is an external view illustrating an example of the image forming apparatus 1 of the embodiment. For example, the image forming apparatus 1 is an MFP. The image forming apparatus 1 reads an image formed on a sheet-like image receiving medium (hereinafter, referred to as a "sheet") such as a paper to generate digital data (image file). The image forming apparatus 1 forms an image on a sheet with toner on the basis of the digital data.

The image forming apparatus 1 is equipped with a display section 110, an image reading section 120, an image forming section 130 and a sheet tray 140.

The display section 110 operates as an output interface to display characters and images. The display section 110 also operates as an input interface to receive an instruction from a user. For example, the display section 110 is a touch panel-type liquid crystal display.

For example, the image reading section 120 is a color scanner. In the color scanner, there are a CIS (Contact Image Sensor) and a CCD (charge coupled devices). The image reading section 120 reads the image formed on the sheet with a sensor to generate the digital data.

The image forming section 130 forms the image on the sheet with the toner. The image forming section 130 forms the image on the basis of image data read by the image reading section 120 or image data received from an external device. For example, the image formed on the sheet is an output image referred to as hard copy, printout and the like.

The sheet tray 140 supplies the sheet used for image output to the image forming section 130.

Figure 2:
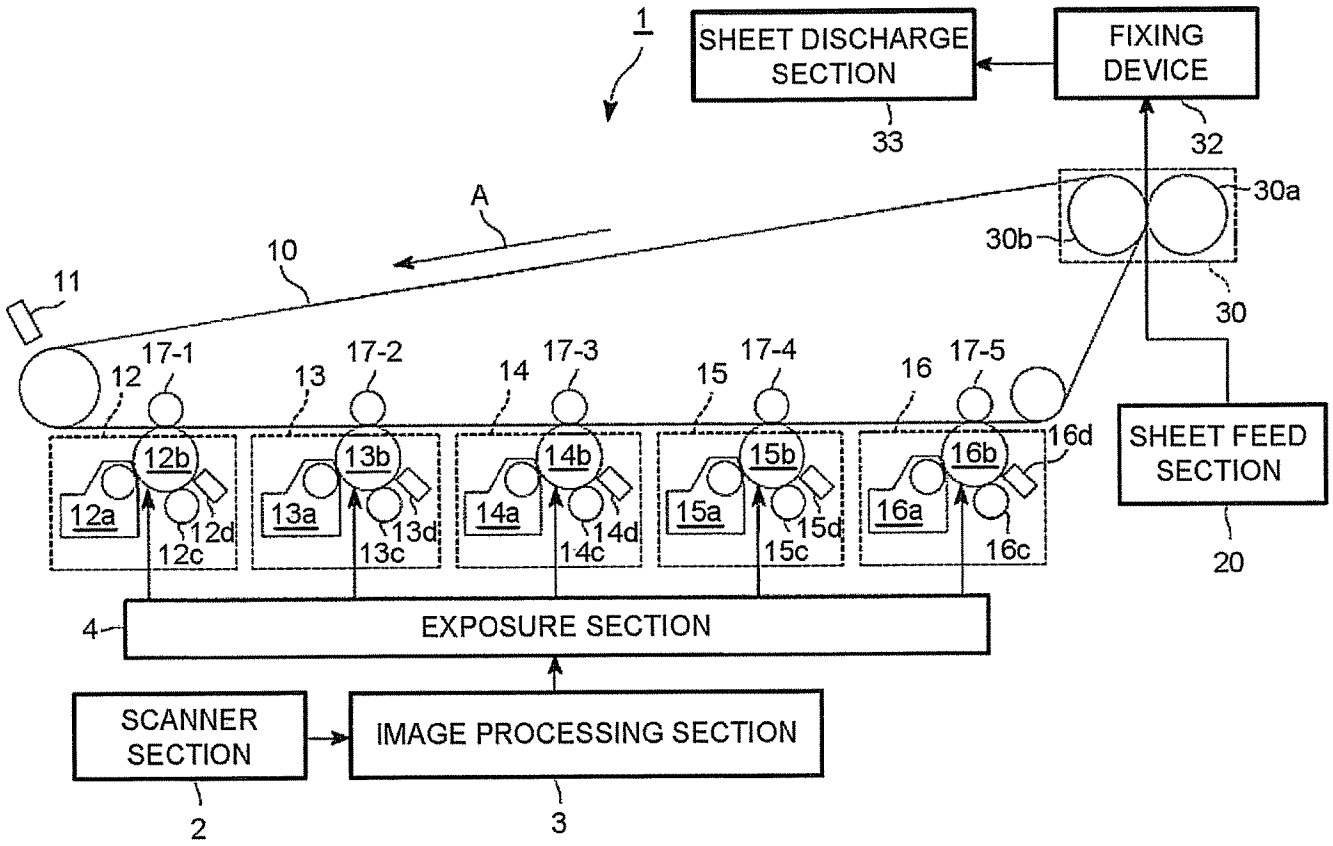
FIG. 2 is a diagram illustrating an example of the schematic configuration of the image forming apparatus according to the embodiment.

FIG. 2 is a diagram illustrating an example of the schematic configuration of the image forming apparatus 1 according to the embodiment. The image forming apparatus 1 is an electrophotographic type image forming apparatus. The image forming apparatus 1 is a 5-tandem type image forming apparatus.

As concrete examples of the toner, there is decoloring toner, non-decoloring toner (normal toner) and decorative toner. The decoloring toner includes decoloring characteristics through external stimulus. "Decoloring" refers to a processing of making an image formed with a color (containing not only chromatic colors but also achromatic colors such as white, black and the like) different from a base color of the sheet invisible visually. For example, the external stimulus includes temperature, light with a specific wavelength and pressure. In the present embodiment, the decoloring toner is decolored upon reaching a specific decoloring temperature or more. The decoloring toner develops a color upon reaching a specific restoration temperature or less after being decolored.

The decoloring toner may be optional toner as long as it includes the foregoing characteristics. For example, a coloring agent of the decoloring toner may be leuco dye. The decoloring toner may be a proper combination of a developer or a decoloring agent, discoloration-temperature regulator and the like.

The image forming apparatus 1 is equipped with a scanner section 2, an image processing section 3, an exposure section 4, an intermediate transfer body 10, a cleaning blade 11, image forming sections 12~16, primary transfer rollers 17-1~17-5, a sheet feed section 20, a secondary transfer section 30, a fixing device 32 and a sheet discharge section 33. Hereinafter, at the time the primary transfer rollers are not distinguished, the primary transfer rollers 17-1~17-5 are simply represented as a primary transfer roller 17.

In the following description, as the sheet is conveyed from the sheet feed section 20 to the sheet discharge section 33, the sheet feed section 20 side is referred to as the upstream side with respect to the sheet conveyance direction, and the sheet discharge section 33 side is referred to as the downstream side with respect to the sheet conveyance direction.

Transfer processes in the image forming apparatus 1 include a first transfer process and a second transfer process. In the first transfer process, the primary transfer roller 17 transfers an image with toner on a photoconductive drum of each image forming section onto the intermediate transfer body 10. In the second transfer process, the secondary transfer section 30 transfers the image with the toner of each color laminated on the intermediate transfer body 10 onto the sheet.

The scanner section 2 reads the image formed on the sheet serving as a scanning object. For example, the scanner section 2 reads the image on the sheet to generate the image data of three primary colors including red (R), green (G) and blue (B). The scanner section 2 outputs the generated image data to the image processing section 3.

The image processing section 3 converts the image data to a color signal of each color. For example, the image processing section 3 converts the image data to image data (color signals) of four colors including yellow (Y), magenta (M), cyan (C) and black (K). The image processing section 3 controls the exposure section 4 on the basis of the color signal of each color.

The exposure section 4 irradiates (exposes) the photoconductive drum of the image forming section with light. The exposure section 4 is equipped with an exposure light source such as a laser, an LED and the like.

The intermediate transfer body 10 is an endless belt. The intermediate transfer body 10 rotates in an arrow A direction shown in FIG. 2. The toner image is formed on the surface of the intermediate transfer body 10.

The cleaning blade 11 removes the toner adhering to the intermediate transfer body 10. For example, the cleaning blade 11 is a plate-like member. For example, the cleaning blade 11 is made from resin such as urethane resin.

The image forming sections 12~16 forms images with toner of each color (five colors in the example shown in FIG. 2). The image forming sections 12~16 are arranged in order along the intermediate transfer body 10.

The primary transfer roller 17 (17-1~17-5) is used at the time of transferring the image with the toner formed by each of the image forming sections 12~16 onto the intermediate transfer body 10.

The sheet feed section 20 feeds the sheet.

The secondary transfer section 30 is one of concrete examples of a secondary transfer body. The secondary transfer section 30 is equipped with a secondary transfer roller 30*a* and a secondary transfer opposite roller 30*b*. The secondary transfer section 30 transfers the image with the toner formed on the intermediate transfer body 10 onto the sheet.

The fixing device 32 fixes the image with the toner transferred onto the sheet on the sheet through heating and pressurizing the image. The sheet on which the image is fixed by the fixing device 32 is discharged from the sheet discharge section 33 to the outside of the apparatus.

Next, the image forming sections 12~16 are described. The image forming sections 12~15 respectively house the toner of each color corresponding to four colors for color printing. The four colors for color printing include, for example, yellow (Y), magenta (M), cyan (C) and black (K). The toner of the four colors for color printing is the non-decoloring toner. The image forming section 16 houses the decoloring toner. The image forming section 12~15 and the image forming section 16 have the same configuration except that the housed toner is different. Thus, the image forming section 12 is described representing the image forming sections 12~16, and the descriptions of other image forming sections 13~16 are omitted.

The image forming section 12 is equipped with a developing device 12*a*, a photoconductive drum 12*b*, a charger 12*c* and a cleaning blade 12*d*.

The developing device 12*a* houses a developing agent. The toner is included in the developing agent. The developing device 12*a* enables the toner to adhere to the photoconductive drum 12*b*.

The photoconductive drum 12*b* is one of concrete examples of an image carrier (image carrying module). The photoconductive drum 12*b* includes a photoconductor (photoconductive area) on the outer peripheral surface thereof. For example, the photoconductor is the organic photoconductor.

The charger 12*c* uniformly charges the surface of the photoconductive drum 12*b*.

The cleaning blade 12*d* removes the toner adhering to the photoconductive drum 12*b*.

Next, the schematic operations of the image forming section 12 are described.

The photoconductive drum 12*b* is charged to predetermined potential through the charger 12*c*. Next, the light is emitted from the exposure section 4 to the photoconductive drum 12*b*. In this way, electric potential at an area irradiated by the light on the photoconductive drum 12*b* changes. Through the change, an electrostatic latent image is formed on the surface of the photoconductive drum 12*b*. The electrostatic latent image on the surface of the photoconductive drum 12*b* is developed through the developing agent in the developing device 12*a*. In other words, an image developed through the toner (hereinafter, referred to as a "developing image") is formed on the surface of the photoconductive drum 12*b*.

The developing image formed on the surface of the photoconductive drum 12*b* is transferred onto the intermediate transfer body 10 through the primary transfer roller 17-1 opposite to the photoconductive drum 12*b* (first transfer process).

Next, the first transfer process by the image forming apparatus 1 is described. Firstly, the primary transfer roller 17-1 opposite to the photoconductive drum 12*b* transfers the developing image on the photoconductive drum 12*b* onto the intermediate transfer body 10. Next, the primary transfer roller 17-2 opposite to a photoconductive drum 13*b* transfers the developing image on the photoconductive drum 13*b* onto the intermediate transfer body 10. Such a processing is carried out even in photoconductive drums 14*b*, 15*b* and 16*b*. At this time, the developing images on the photoconductive drums 12*b*~16*b* are respectively transferred onto the intermediate transfer body 10 to be overlapped with each other. Thus, the developing images with the toner of each color are overlapped and transferred onto the intermediate transfer body 10 after passing the image forming section 16.

However, in a case in which an image forming processing using only the non-decoloring toner is carried out, the image forming sections 12~15 operate. Through such an operation, the developing images using only the non-decoloring toner are formed on the intermediate transfer body 10. Further, in a case in which an image forming processing using only the decoloring toner is carried out, the image forming section 16 operates. Through such an operation, the developing image using only the decoloring toner is formed on the intermediate transfer body 10.

Next, the second transfer process is described. A voltage (bias) is applied to the secondary transfer opposite roller 30*b*. Thus, an electric field is generated between the secondary transfer opposite roller 30*b* and the secondary transfer roller 30*a*. Through the electric field, the secondary transfer section 30 transfers the developing image formed on the intermediate transfer body 10 onto the sheet.

Hereinafter, the fixing device 32 is described in detail.

Figure 3:
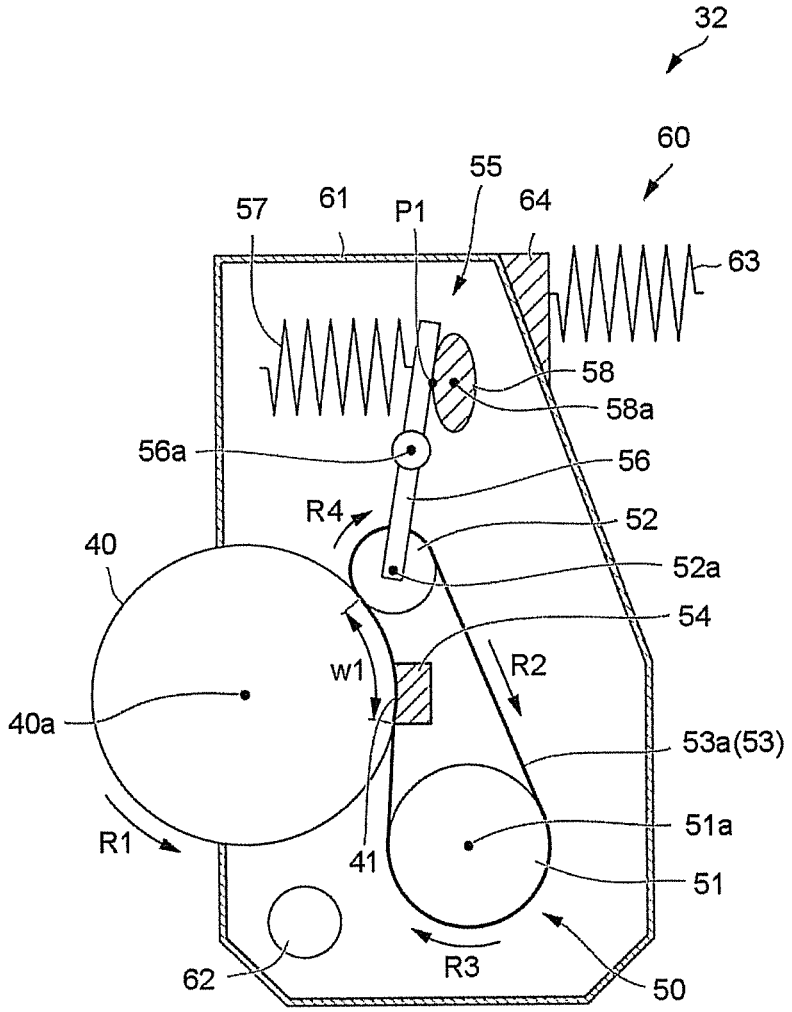
FIG. 3 is a diagram illustrating an example of the schematic configuration of a fixing device according to the embodiment.

FIG. 3 is a diagram illustrating an example of the schematic configuration of the fixing device 32 according to the embodiment.

As shown in FIG. 3, the fixing device 32 is equipped with a heat roller 40 (first rotating body), a pressure unit 50, a first mechanism 55 and a second mechanism 60.

Firstly, the heat roller 40 serving as a heating unit is described.

The heat roller 40 is an endless fixing member. The heat roller 40 includes a bent outer peripheral surface. In other words, the heat roller 40 is formed into a cylindrical shape. The heat roller 40 includes a metal roller. For example, the heat roller 40 includes a resin layer such as fluorine resin on the outer peripheral surface an aluminum roller. The heat roller 40 is rotatable centering on a first axis 40*a*. The first axis 40*a* refers to the central axis (axis of rotation) of the heat roller 40.

The fixing device 32 is further equipped with a heat source (not shown) for heating the heat roller 40. For example, heat source may be a resistance heat generating body such as a thermal head, a ceramic heater, a halogen lamp, an electromagnetic induction heating unit and the like. The position of the heat source may be arranged inside the heat roller 40 or outside the heat roller 40.

Next, the pressure unit 50 is described.

The pressure unit 50 is equipped with a plurality of rollers 51 and 52, a belt 53 (second rotating body) and a pressure pad 54 (pressure member).

A plurality of the rollers 51 and 52 is arranged inside the belt 53. In the present embodiment, a plurality of the rollers 51 and 52 is composed of a first roller 51 and a second roller 52. A plurality of the rollers 51 and 52 may be the same roller or different rollers.

A plurality of the rollers 51 and 52 is rotatable respectively centering on a plurality of axes of rotation 51*a* and 52*a* parallel to the first axis 40*a*. A plurality of the rollers 51 and 52 is arranged at positions contributing to formation of a nip 41.

The first roller 51 is arranged at the upstream side in the sheet conveyance direction with respect to the second roller 52. The first roller 51 is formed into a cylindrical shape. For example, the first roller 51 is a roller made from metal such as iron. The first roller 51 is rotatable centering on the first axis of rotation 51*a* parallel to the first axis 40*a*. The first axis of rotation 51*a* refers to the central axis of the first roller 51.

The second roller 52 is arranged at the downstream side in the sheet conveyance direction with respect to the first roller 51. The second roller 52 is formed into a cylindrical shape. The external of the second roller 52 is smaller than that of the first roller 51. For example, the second roller 52 is a roller made from metal such as iron. The second roller 52 is rotatable centering on the second axis of rotation 52*a* parallel to the first axis 40*a*. The second axis of rotation 52*a* refers to the central axis of the second roller 52.

The belt 53 faces the heat roller 40. The belt 53 is stretched over the first roller 51 and the second roller 52. The belt 53 is formed into an endless shape. In other words, the belt 53 is a rotating body stretched over a plurality of the rollers 51 and 52.

The belt 53 is equipped with abase layer 53*a* and a release layer (not shown). For example, the base layer 53*a* is formed by polyimide resin (PI). For example, the release layer is formed by fluorine resin such as tetrafluoroethylene-perfluoroalkyl vinyl ether copolymer resin (PFA). The layer structure of the belt 53 is not limited. A film-like member is included on the belt 53.

The pressure pad 54 is formed into a right-angled parallelepiped shape. For example, the pressure pad 54 is formed by a resin material such as heat-resistant PPS (Polyphenylene Sulfide Resin), LCP (Liquid Crystal Polymer), PF (Phenol Resin) and the like. The pressure pad 54 is arranged at a position opposite to the heat roller 40 across the belt 53. The pressure pad 54 is energized towards the heat roller 40 through an energization member such as a spring (not shown). The pressure pad 54 abuts against the inner peripheral surface of the belt 53 to push the belt 53 against the heat roller 40 to form the nip 41. In other words, the pressure pad 54 presses the inner peripheral surface of the belt 53 towards the heat roller 40 side to form the nip 41 between the belt 53 and the heat roller 40.

Figure 4:
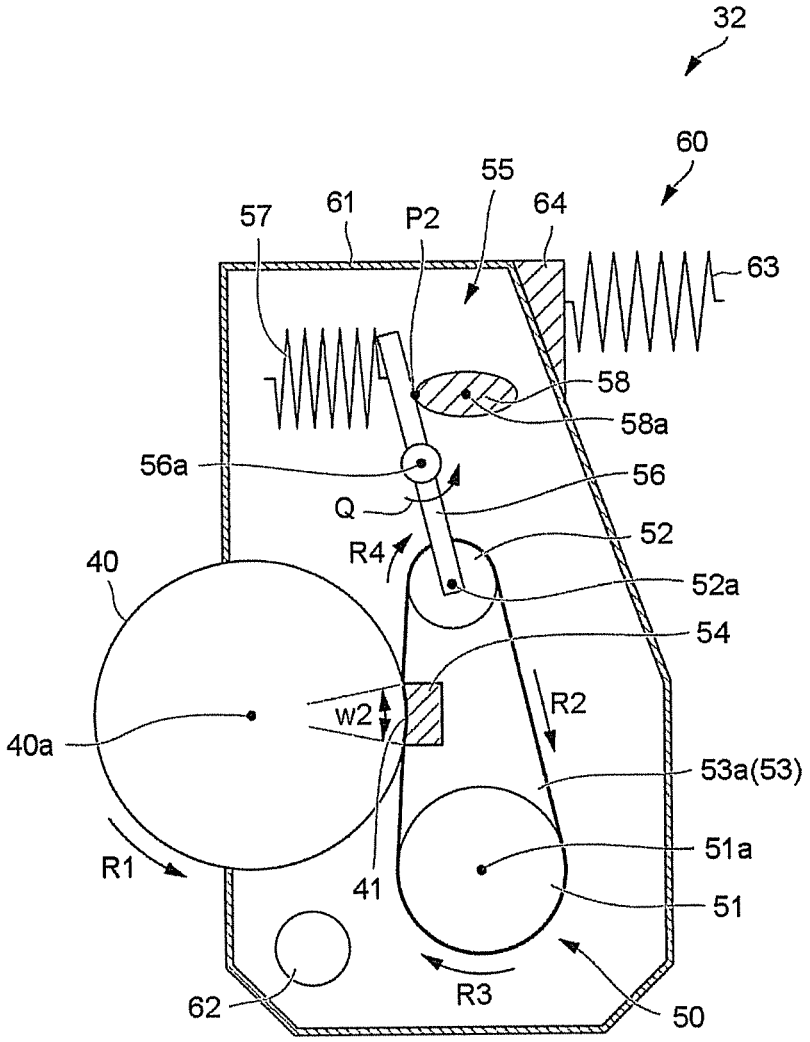
FIG. 4 is a view illustrating operations of a first mechanism according to the embodiment.

Next, the first mechanism 55 is described. FIG. 4 is a view illustrating operations of the first mechanism 55 according to the embodiment.

The first mechanism 55 enables the second roller 52 to move independently of the first roller 51. The first mechanism 55 can change a nip width between the belt 53 and the heat roller 40 by enabling the second roller 52 to move independently of the first roller 51. The first mechanism 55 enables part of the belt 53 to move in an abutting direction against the heat roller 40 and a separation direction from the heat roller 40 by enabling the second roller 52 to move independently of the first roller 51. The first mechanism 55 can increase and decrease pressurizing force generated in the nip 41 by enabling the second roller 52 to move independently of the first roller 51. The first mechanism 55 enables the second roller 52 to move between a first position and a second position. The first position is a position (refer to FIG. 3) at which the second roller 52 pressures the heat roller 40 across the belt 53. At the first position shown in FIG. 3, the belt 53 and the heat roller 40 form an arc-shaped nip 41. The second position is a position (refer to FIG. 4) at which the second roller 52 is separated from the heat roller 40 with respect to the first position. At the second position shown in FIG. 4, the belt 53 and the heat roller 40 form an arc-shaped (substantially, linear) nip 41 more gradual than that at the first position. At the second position, the nip 41 having the substantially same width as the pressure pad 54 is formed. The width of the pressure pad 54 refers to a length of the pressure pad 54 in the sheet conveyance direction. At the second position, the belt 53 and the heat roller 40 are abutted at a length substantially identical to the width of the pressure pad 54.

The first mechanism 55 is equipped with an arm 56, an arm energization member 57 and a cam 58.

The arm 56 is a rod-shaped member. The arm 56 is rotatable centering on a fulcrum 56*a*. The arm 56 rotatably supports the second roller 52 at one end part.

For example, the arm energization member 57 is a coil spring. The arm energization member 57 is mounted on the other end part of the arm 56. The other end part of the arm 56 is energized in a direction contacting with the cam 58. The arm energization member 57 energizes the other end part of the arm 56 to position the second roller 52 at the first position.

The cam 58 rotates centering on a fulcrum 58*a* through rotation of a motor (not shown). The cam 58 presses the arm 56 against energization force of the arm energization member 57 to be capable of arranging the second roller 52 at the second position.

If a distance between a point at which the cam 58 contacts with the arm 56 and the fulcrum 58*a* is smaller than a predetermined distance, the second roller 52 abuts against the heat roller 40 across the belt 53. If the distance between a point at which the cam 58 contacts with the arm 56 and the fulcrum 58*a* is larger than the predetermined distance, the second roller 52 is separated from the heat roller 40. Thus, in response to the rotation of the cam 58 caused by the motor drive, abutting and separation of the second roller 52 and the heat roller 40 can be controlled.

In the state shown in FIG. 3, the distance between a point P1 at which the cam 58 contacts with the arm 56 and the fulcrum 58*a* is the minimum. In the state shown in FIG. 3, the second roller 52 abuts against the heat roller 40 across the belt 53. Thus, the predetermined pressurizing force is guaranteed in the nip 41 (specifically, at the downstream end of the nip 41 in the sheet conveyance direction, which is simply referred to as "downstream end of the nip 41" hereinafter).

In the state shown in FIG. 4, the distance between a point P2 at which the cam 58 contacts with the arm 56 and the fulcrum 58*a* is the maximum. In this case, the arm 56 rotates in a direction (direction separating from the heat roller 40) indicated by an arrow Q centering on the fulcrum 56*a*. In the state shown in FIG. 4, the second roller 52 is separated from the heat roller 40. Thus, the pressurizing force generated in the nip 41 (specifically, at the downstream end of the nip 41) is decreased compared with the state shown in FIG. 3. Further, in the state shown in FIG. 4, the nip width is smaller than that in the state shown in FIG. 3.

The "nip width" refers to a length of a part where the belt 53 and the heat roller 40 contact with each other in the sheet conveyance direction. A nip width w1 in the state shown in FIG. 3 is a nip width at the first position. The nip width at the first position is a length from the upstream side of the pressure pad 54 to the second roller 52 in the arc shape. A nip width w2 in the state shown in FIG. 4 is a nip width at the second position. The nip width at the second position is a length substantially identical to the width of the pressure pad 54. The nip width w2 is smaller than the nip width w1 ($w2<w1$).

Hereinafter, a rotation direction of the heat roller 40 and the like is described.

The heat roller 40 rotates in an arrow R1 direction through a motor (not shown). In other words, the heat roller 40 rotates in the arrow R1 direction independently of the pressure unit 50.

The belt 53 is driven by the heat roller 40 to rotate in an arrow R2 direction. In other words, the belt 53 abuts against the outer peripheral surface of the heat roller 40 which rotates in the arrow R1 direction to be driven to rotate.

The first roller 51 is driven by the belt 53 to rotate in an arrow R3 direction. The second roller 52 is driven by the belt 53 to rotate in an arrow R4 direction. In other words, the first roller 51 and the second roller 52 abut against the inner peripheral surface of the belt 53 which rotates in the arrow R2 direction to be driven to rotate.

Next, the second mechanism 60 is described.

Figure 5:
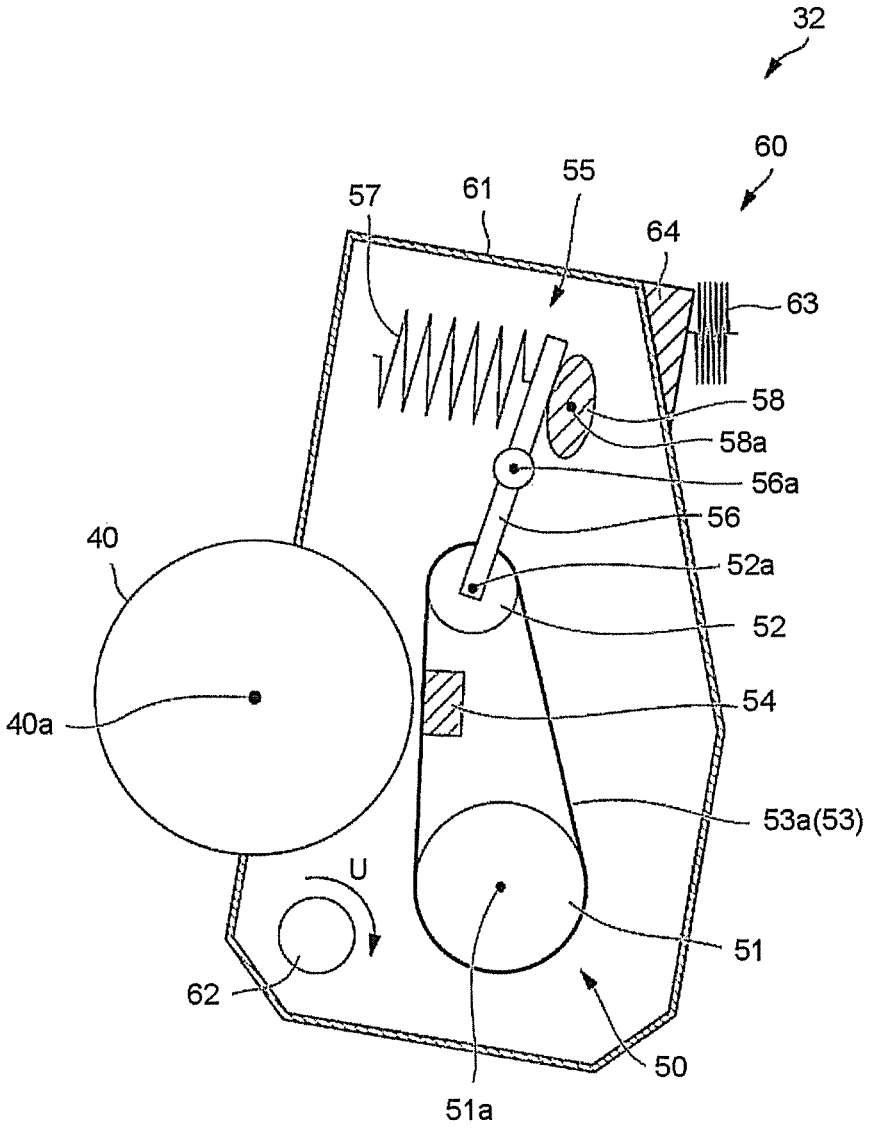
FIG. 5 is a view illustrating operations of a second mechanism according to the embodiment.

FIG. 5 is a view illustrating operations of the second mechanism 60 according to the embodiment.

The second mechanism 60 enables the pressure unit 50 and the first mechanism 55 to move in an abutting direction against the heat roller 40 and a separation direction from the heat roller 40. The second mechanism 60 enables the pressure unit 50 to move between an abutting position and a separation position. The abutting position is a position at which the belt 53 abuts against the heat roller 40 (refer to FIG. 3 and FIG. 4). The separation position is a position at which the belt 53 is separated from the heat roller 40 (refer to FIG. 5). In other words, the belt 53 abuts against or is separated from the heat roller 40 through the operation of the second mechanism 60 (movement of the pressure unit 50).

The second mechanism 60 enables the first mechanism 55 and the pressure unit 50 to move in the abutting direction against the heat roller 40 and the separation direction from the heat roller 40. The second mechanism 60 enables the pressure pad 54 and the belt 53 to move in the abutting direction against the heat roller 40 and the separation direction from the heat roller 40. In other words, the second mechanism 60 is possible to integrally move a plurality of the rollers 51 and 52, the belt 53, the pressure pad 54 and the first mechanism 55.

The second mechanism 60 is equipped with a frame 61, a support shaft 62, a frame energization member 63 and a drive section 64.

The frame 61 is a box-like member for housing the pressure unit 50 and the first mechanism 55. The frame 61 supports a plurality of the rollers 51 and 52, the belt 53, the pressure pad 54 and the first mechanism 55.

The support shaft 62 is formed into a cylindrical shape parallel to the first axis 40*a*. The support shaft 62 rotatably supports one end part of the frame 61.

For example, the frame energization member 63 is the coil spring. The frame energization member 63 is mounted on the other end part of the frame 61 across the drive section 64. The frame energization member 63 energizes the other end part of the frame 61 through the drive section 64 so that the belt 53 abuts against the heat roller 40.

The drive section 64 is mounted on the other end part of the frame 61. The drive section 64 moves along an energization direction of the frame energization member 63 through the drive of a motor (not shown). The drive section 64 rotates the frame 61 centering on the support shaft 62 against the energization force of the frame energization member 63 in an arrow U direction to be capable of moving the frame 61 so that the belt 53 is separated from the heat roller 40.

Next, types of the image forming processing carried out by the image forming apparatus 1 (refer to FIG. 1) of the embodiment are described. The image forming apparatus 1 carries out printing in three modes shown below.

- Monochrome mode: forming an image with non-decoloring black monochromatic toner.
- Color mode: forming an image with non-decoloring monochrome toner and color toner.
- Decoloring toner mode: forming an image with only decoloring toner.

Which kind of mode can be selected to carry out the image forming processing according to an operation of the user on the display section 110 of the image forming apparatus 1.

In the monochrome mode, the image forming section using the non-decoloring toner of black (K) operates to form an image. The monochrome mode is selected in a case in which the user wants to print a general monochrome image. For example, the monochrome mode is used in a case in which the user wants to store a paper as important data without reusing the paper.

In the color mode, four image forming sections respectively using the non-decoloring toner of yellow (Y), magenta (M), cyan (C) and black (K) operate to form an image. The color mode is selected in a case in which the user wants to print a color image.

In the decoloring toner mode, only the image forming section using the decoloring toner operates to form an image. The decoloring toner mode is selected in a case in which the user wants to reuse a paper on which an image is formed.

As shown in FIG. 1, the display section 110 is equipped with a button 150 (operation section) for enabling the first mechanism 55 to operate to increase and decrease the pressurizing force generated in the nip 41 according to the type of the image receiving medium.

The type of the image receiving medium includes a first image receiving medium and a second image receiving medium.

The first image receiving medium refers to one sheet having a flat surface without folds. For example, the first image receiving medium is copy paper such as A4 paper and A3 paper.

The second image receiving medium includes a plurality of the sheets, and at least one part of the sheets are bonded in a state in which a plurality of the sheets is overlapped. In the second image receiving medium, one sheet which is folded at a predetermined position is included. For example, the second image receiving medium is a sheet folded in two, an envelope, a clear file and the like.

Next, functional components of the image forming apparatus 1 are described.

Figure 6:
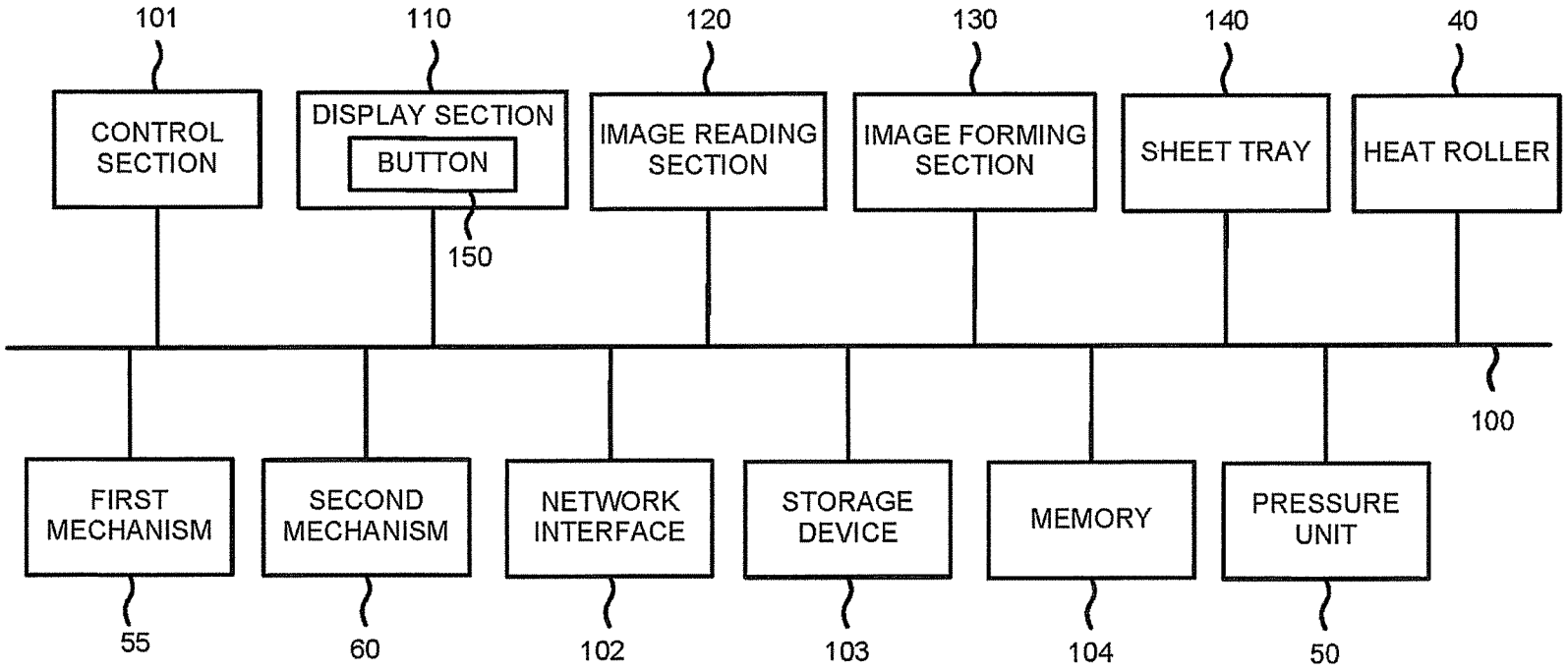
FIG. 6 is a block diagram illustrating an example of functional components of the image forming apparatus according to the embodiment.

FIG. 6 is a block diagram illustrating an example of the functional components of the image forming apparatus 1 according to the embodiment.

As shown in FIG. 6, functional sections of the image forming apparatus 1 are connected with each other in a communicable manner via a system bus 100.

A control section 101 controls an operation of each functional section of the image forming apparatus 1. The control section 101 carries out a program to carry out various processing. The control section 101 acquires the instruction input by the user from the display section 110. The control section 101 carries out a control processing on the basis of the acquired instruction.

The network interface 102 carries out transmission or reception of data to or from other devices. The network interface 102 operates as the input interface to receive the data sent from the other devices. Further, the network interface 102 operates as the output interface to send the data to the other devices.

A storage device 103 stores various data. For example, the storage device 103 is a hard disk or an SSD (Solid State Drive). For example, various data refers to the digital data, screen data of a setting screen, setting information, a job and a job log. The digital data is generated by the image reading section 120. The setting screen is used to carry out operation setting of the first mechanism 55 or the second mechanism 60. The setting information relates to the operation setting of the first mechanism 55 or the second mechanism 60.

A memory 104 temporarily stores data used by each functional section. For example, the memory 104 is an RAM (Random Access Memory). For example, the memory 104 temporarily stores the digital data, the job and the job log.

Next, the operation of the fixing device 32 corresponding to the type of the image receiving medium is described.

The control section 101 controls the operation of the first mechanism 55 according to the type of the image receiving medium. In a case in which the image receiving medium is the first image receiving medium, the first mechanism 55 does not operate, and the second roller 52 abuts against the heat roller 40 across the belt 53 without any change (refer to FIG. 3). Thus, the predetermined pressurizing force is guaranteed in the nip 41 (specifically, at the downstream end of the nip 41).

On the other hand, in a case in which the image receiving medium is the second image receiving medium, the first mechanism 55 operates through the button 150 (refer to FIG. 1) to separate the second roller 52 from the heat roller 40. For example, the user selects the envelope at the time of selecting the sheet and presses the button 150 to enable the cam 58 to rotate through the motor to switch to the state shown in FIG. 4. Thus, the pressurizing force generated in the nip 41 (specifically, at the downstream end of the nip 41) is decreased compared with the state shown in FIG. 3. Further, in the state shown in FIG. 4, the nip width is smaller than that in the state shown in FIG. 3.

In the state shown in FIG. 3, the belt 53 is pressured to the heat roller 40 through the pressurizing force of the second mechanism 60 and the pressurizing force of the first mechanism 55 to the second roller 52. On the other hand, in the state shown in FIG. 4, as the second roller 52 is separated from the heat roller 40, the pressurizing force of the first mechanism 55 is 0. However, in the state shown in FIG. 4, the pressure unit 50 pressures the heat roller 40 through the second mechanism 60. Thus, the pressurizing force generated in the nip 41 is not 0.

Next, the operation of the fixing device 32 corresponding to a conveyance state of the image receiving medium is described.

The control section 101 controls the operation of the second mechanism 60 according to the conveyance state of the image receiving medium. In a case of the conveyance (passing) of the image receiving medium, the second mechanism 60 does not operate, and the heat roller 40 and the belt 53 abut against each other without any change (refer to FIG. 3 and FIG. 4). Thus, the predetermined pressurizing force is guaranteed in the nip 41.

On the other hand, in a case of the non-conveyance (non-passing) of the image receiving medium, the second mechanism 60 operates to enable the heat roller 40 and the belt 53 to be separated from each other (refer to FIG. 5). Thus, in the state shown in FIG. 5, as the pressure unit 50 does not pressurize the heat roller 40, the pressurizing force generated in the nip 41 is 0.

Incidentally, according to the type of the image receiving medium, if the image receiving medium in the nip width is bent along the outer peripheral surface of the heat roller 40, there is a possibility that a wrinkle is generated on the image receiving medium. Specifically, if the envelope in the nip width is bent along the outer peripheral surface of the heat roller 40, a difference in the conveyance speed of the envelope is generated at the heat roller 40 side and the belt 53 side. Thus, in a case of using the envelope as the image receiving medium, there is a possibility that the wrinkle is generated on the envelope at the heat roller 40 side.

According to the embodiment, the fixing device 32 is equipped with the heat roller 40, the belt 53 and the first mechanism 55. The belt 53 faces the heat roller 40. The belt 53 is stretched over a plurality of the rollers 51 and 52. The first mechanism 55 enables the second roller 52 between a plurality of the rollers 51 and 52 to move to change the nip width between the heat roller 40 and the belt 53. Through the foregoing configuration, the following effects are achieved. At the time of the passing of the image receiving medium, the nip width can be changed. Thus, it can be suppressed that the wrinkle is generated on the image receiving medium.

Specifically, in a case of using the envelope as the image receiving medium, the generation of the wrinkle can be effectively suppressed. A case of the passing of the envelope is the same as a case in which the envelope is conveyed by overlapping two sheets. Thus, in a case of conveying the envelope to the arc-shaped nip width as shown in FIG. 3, a difference between a conveyance distance of the sheet at the inner side of the envelope and a conveyance distance of the sheet at the outer side of the envelope is generated, and there is a possibility that the wrinkle is generated on the envelope. However, according to the embodiment, in a case of conveying the envelope, as shown in FIG. 4, the nip width can be shortened. Through shortening the nip width, the shape of the nip 41 can become linear shape in which the difference between the conveyance distance of the sheet at the inner side of the envelope and the conveyance distance of the sheet at the outer side of the envelope is difficult to generate. Thus, the generation of the wrinkle can be effectively suppressed. The thickness of the envelope is thicker than that of the copy paper. Thus, even if the nip width is short, if pressure required for fixation can be guaranteed in the nip width, the image can be fixed on the envelope.

The first mechanism 55 can move the second roller 52 between the first position and the second position. The nip width at the second position is substantially identical to the width of the pressure pad 54. Through the foregoing configuration, the following effects are achieved. Compared with a case of holding the second roller 52 at the first position without any change, an increase and decrease range of the nip width (adjustment range of the nip width) can be greatly guaranteed. In addition, the nip width at the second position can be shortened (become shortest) as far as possible to the width of the pressure pad 54. Thus, according to the type of the image receiving medium, the generation of the wrinkle can be effectively suppressed. In addition, compared with a case of holding the second roller 52 at the first position without any change, an increase and decrease range of the pressurizing force (adjustment range of the pressurizing force) generated in the nip 41 can be greatly guaranteed.

The fixing device 32 is equipped with the first mechanism 55 and the second mechanism 60. In other words, with further including the second mechanism 60 in the fixing device 32, the following effects are achieved. Compared with a case in which only the first mechanism 55 is included in the fixing device 32, abutting or separation of the heat roller 40 and the belt 53 can be easily switched. In addition, through the second mechanism 60, the belt 53 can be separated from the heat roller 40 at the non-sheet-passing time. Thus, compared with a case in which the belt 53 abuts against the heat roller 40 without any change, heat capacity of the heat roller 40 can be reduced. Thus, time of warming up can be shortened and time of fast print can be shortened.

The following effect is achieved in such a manner that the first mechanism 55 enables the second roller 52 between a plurality of the rollers 51 and 52 to move and enables part of the belt 53 to move in the abutting direction against the heat roller 40 and the separation direction from the heat roller 40. Compared with a case in which part of the belt 53 moves in the abutting direction against the heat roller 40 and the separation direction from the heat roller 40 through only the second mechanism 60, partial abutting or separation of the heat roller 40 and the belt 53 can be easily carried out.

The following effect is achieved in such a manner that the second mechanism 60 enables the pressure pad 54 and the belt 53 to move in the abutting direction against the heat roller 40 and the separation direction from the heat roller 40. Compared with a case in which the belt 53 and the pressure pad 54 separately move, the configuration of the second mechanism 60 can be simplified.

The second roller 52 can move between the first position and the second position through the first mechanism 55. Through the foregoing configuration, the following effects are achieved. Compared with a case in which both of the first roller 51 and the second roller 52 move, the change of the nip width can be easily carried out. In addition, compared with a case in which only the first roller 51 moves, the conveyance route of the sheet is easy to be guaranteed.

The pressurizing force generated in the nip 41 can be increased and decreased in such a manner that the first mechanism 55 enables the second roller 52 to move independently of the first roller 51. Through the foregoing configuration, the following effects are achieved. At the time of the passing of the image receiving medium, the pressurizing force generated in the nip 41 can be increased and decreased. Thus, it can be prevented that the wrinkle is generated on the image receiving medium. Specifically, in a case of using the envelope as the image receiving medium, the generation of the wrinkle can be effectively suppressed. For example, at the time of the passing of the envelope, the generation of the wrinkle can be effectively suppressed by reducing the pressurizing force generated in the nip 41. The thickness of the envelope is thicker than that of the copy paper. Thus, even if the pressurizing force generated in the nip 41 is reduced, if the pressure required for the fixation can be guaranteed in the nip width, the image can be fixed on the envelope.

The first mechanism 55 is equipped with the arm 56, the arm energization member 57 and the cam 58. The arm 56 rotatably supports the second roller 52 at one end part. The arm energization member 57 energizes the other end part of the arm 56 to position the second roller 52 at the first position. The cam 58 presses the arm 56 against the energization force of the arm energization member 57 to be capable of arranging the second roller 52 at the second position. Through the foregoing configuration, the following effect is achieved. Through the simple configuration using the cam 58, it can be suppressed that the wrinkle is generated on the image receiving medium.

The second mechanism 60 is equipped with the frame 61, the support shaft 62, the frame energization member 63 and the drive section 64. The frame 61 supports the belt 53 and the first mechanism 55. The support shaft 62 rotatably supports one end part of the frame 61. The frame energization member 63 energizes the other end part of the frame 61 so that the belt 53 abuts against the heat roller 40. The drive section 64 rotates the frame 61 centering on the support shaft 62 against the energization force of the frame energization member 63 to possibly move the frame 61 so that the belt 53 is separated from the heat roller 40. Through the foregoing configuration, the following effect is achieved. Through the simple configuration using the frame 61, the abutting or separation of the heat roller 40 and the belt 53 can be easily switched The following effect is achieved in such a manner that the second mechanism 60 can enable the pressure unit 50 and the first mechanism 55 to integrally move. Compared with a case in which the pressure unit 50 and the first mechanism 55 separately move, the second mechanism 60 can be simplified.

The first mechanism 55 enables the second roller 52 to move independently of the first roller 51 to possibly adjust the nip width. Through the foregoing configuration, the following effects are achieved. At the time of the passing of the image receiving medium, a degree of curvature of the image receiving medium can be reduced by reducing the nip width. Thus, it can be suppressed that the wrinkle is generated on the image receiving medium.

The image forming apparatus 1 is not limited to including the button 150 that enables the first mechanism 55 to operate to increase and decrease the pressurizing force generated in the nip 41 according to the type of the image receiving medium. Through the foregoing configuration, the following effects are achieved. According to the type of the image receiving medium, at the time of the passing of the image receiving medium, the pressurizing force generated in the nip 41 can be automatically increased and decreased by operating the button 150. Thus, according to the type of the image receiving medium, it can be easily prevented that the wrinkle is generated on the image receiving medium.

Hereinafter, modifications are described.

The fixing device 32 is not limited to including the heat source in the heat roller 40. For example, the heat source may be arranged at the pressure pad 54 side or the rollers 51 and 52 side.

The fixing device 32 is not limited to using a lamp heating system. For example, the fixing device 32 may use an electromagnetic induction heating system (IH system) for heating a conductive layer of the belt by electromagnetic induction.

The pressure member is not limited to the right-angled parallelepiped pressure pad 54. For example, the pressure member may be a roller having a bent outer peripheral surface.

A plurality of the rollers 51 and 52 is not limited to be composed of the first roller 51 and the second roller 52. For example, a plurality of rollers may be composed of three or more rollers.

The first mechanism 55 is not limited to enabling the second roller 52 to move independently of the first roller 51. For example, the first mechanism 55 may enable the first roller 51 to move independently of the second roller 52. In other words, the first mechanism 55 may enable at least one between a plurality of the rollers 51 and 52 (specifically, at least one of the rollers arranged at the positions contributing to the formation of the nip 41) to move independently of the other roller.

The image forming apparatus 1 is not limited to including the button 150 that enables the first mechanism 55 to operate to increase and decrease the pressurizing force generated in the nip 41 according to the type of the image receiving medium. For example, the image forming apparatus 1 may include a lever that enables the first mechanism 55 to mechanically operate to increase and decrease the pressurizing force generated in the nip 41 according to the type of the image receiving medium. In other words, it may be appropriate that the first mechanism 55 can manually operate.

The first roller 51 and the second roller 52 are not limited to being driven to rotate by abutting against the inner peripheral surface of the belt 53 that rotates through the rotation of the heat roller 40. For example, at least one of the first roller 51 and the second roller 52 may operate independently of the heat roller 40. In other words, the heat roller 40 may be driven to rotate by abutting against the outer peripheral surface of the belt 53 that rotates through the rotation of at least one of the first roller 51 and the second roller 52.

According to at least one embodiment described above, the heat roller 40, the belt 53 and the first mechanism 55 are included. The belt 53 faces the heat roller 40. The belt 53 is stretched over a plurality of the rollers 51 and 52. The first mechanism 55 enables the second roller 52 between a plurality of the rollers 51 and 52 to move to change the nip width between the heat roller 40 and the belt 53. Through the foregoing configuration, the following effect is achieved. At the time of the passing of the image receiving medium, the nip width can be changed. Thus, it can be suppressed that the wrinkle is generated on the image receiving medium.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A fixing device, comprising:

a first rotating body;

a first roller configured to face at least the first rotating body;

a second roller arranged at the downstream side of a moving direction of the first rotating body;

a second rotating body configured to face the first rotating body and be stretched over the first roller and the second roller;

a first mechanism configured to enable the second roller to move to change a nip width between the first rotating body and the second rotating body; and a control section which controls an operation of the first mechanism according to the type of an image receiving medium, wherein:

in a case in which the image receiving medium is a first image receiving medium having a single sheet form, the second roller pressures against the first rotating body across the second rotating body, and provides a predetermined pressurizing force in the nip, in a case in which the image receiving medium is a second image receiving medium including a plurality of sheets, each of which is bonded to each other at at least one part of the sheets, the first mechanism operates to separate the second roller from the first rotating body, and decreases a pressurizing force generated in the nip compared with the case in which the image receiving medium is the first image receiving medium, and makes the nip width smaller than the case in which the image receiving medium is the first image receiving.

2. The fixing device according to claim 1, further, comprising a pressure member configured to push the second rotating body against the first rotating body, wherein the first mechanism enables the second roller to move between a first position at which the second roller pressures the first rotating body across the second rotating body and a second position at which the second roller is separated from the first rotating body with respect to the first position; and the nip width between the first rotating body and the second rotating body is substantially identical to a width of the pressure member when the second roller is positioned at the second position.

3. A fixing device, comprising;

a first rotating body;

a first roller configured to face at least the first rotating body;

a second roller arranged at the downstream side of a moving direction of the first rotating body;

a second rotating body configured to face the first rotating body and be stretched over the first roller and the second roller;

a first mechanism capable of enabling part of the second rotating body to move in an abutting direction against the first rotating body and a separation direction from the first rotating body;

a second mechanism capable of enabling the second rotating body to move in the abutting direction against the first rotating body and the separation direction from the first rotating body; and a control section which controls an operation of the first mechanism according to the type of an image receiving medium, wherein:

in a case in which the image receiving medium is a first image receiving medium having a single sheet form, the second roller pressures against the first rotating body across the second rotating body, and provides a predetermined pressurizing force in the nip, in a case in which the image receiving medium is a second image receiving medium including a plurality of sheets, each of which is bonded to each other at at least one part of the sheets, the first mechanism operates to separate the second roller from the first rotating body, and decreases a pressurizing force generated in the nip compared with the case in which the image receiving medium is the first image receiving medium, and makes the nip width smaller than the case in which the image receiving medium is the first image receiving.

4. The fixing device according to claim 3, wherein the first mechanism enables the second roller to move and enables part of the second rotating body to move in the abutting direction against the first rotating body and the separation direction from the first rotating body.

5. The fixing device according to claim 3, further comprising a pressure member configured to push the second rotating body against the first rotating body, wherein the second mechanism enables the pressure member and the second rotating body to move in the abutting direction against the first rotating body and the separation direction from the first rotating body.

6. The fixing device according to claim 1, wherein the second roller can move through the first mechanism between a first position at which the second roller pressures the first rotating body across the second rotating body and a second position serving as a position at which the second roller is separated from the first rotating body with respect to the first position.

7. The fixing device according to claim 6, wherein the first mechanism enables the second roller to move independently of the first roller to increase and decrease pressurizing force generated in a nip between the first rotating body and the second rotating body.

8. The fixing device according to claim 6, further comprising:

an arm configured to rotatably support the second roller at one end part;

an arm energization member configured to energize the other end part of the arm to position the second roller at the first position; and a cam configured to press the arm against energization force of the energization member to arrange the second roller at the second position.

9. The fixing device according to claim 1, further comprising a second mechanism configured to enable the second rotating body to move in an abutting direction against the first rotating body and a separation direction from the first rotating body.

10. The fixing device according to claim 9, further comprising:

a frame configured to support the second rotating body and the first mechanism;

a support shaft configured to rotatably support one end part of the frame;

a frame energization member configured to energize the other end part of the frame so that the second rotating body abuts against the first rotating body; and a drive section configured to enable the frame to be driven centering on the support shaft against the energization force of the frame energization member to separate the second rotating body from the first rotating body.

11. A fixing method, comprising;

moving a part of a second rotating body in an abutting direction against a first rotating body and a separation direction from the first rotating body, the second rotating body facing the first rotating body;

moving the second rotating body and a pressure member in the abutting direction against the first rotating body and the separation direction from the first rotating body; and controlling an operation of a first mechanism according to the type of an image receiving medium, wherein:

the second rotating body is stretched over a first roller and a second roller, the first roller faces at least the first rotating body, the second roller is arranged at the downstream side of a moving direction of the first rotating body, in a case in which the image receiving medium is a first image receiving medium having a single sheet form, the second roller pressures against the first rotating body across the second rotating body, and provides a predetermined pressurizing force in the nip, in a case in which the image receiving medium is a second image receiving medium including a plurality of sheets, each of which is bonded to each other at at least one part of the sheets, the first mechanism operates to separate the second roller from the first rotating body, and decreases a pressurizing force generated in the nip compared with the case in which the image receiving medium is the first image receiving medium, and makes the nip width smaller than the case in which the image receiving medium is the first image receiving.

12. The fixing method according to claim 11, wherein the moving a part of a second rotating body comprises moving the second roller.

13. The fixing method according to claim 11, wherein moving the pressure member comprises pushing the second rotating body against the first rotating body.

14. The fixing method according to claim 11, further comprising the moving a part of a second rotating body enables the second roller to move between a first position at which the second roller pressures the first rotating body across the second rotating body and a second position at which the second roller is separated from the first rotating body with respect to the first position; and a nip width between the first rotating body and the second rotating body is substantially identical to a width of the pressure member when the second roller is positioned at the second position.

* * * * *